US006807839B2

(12) United States Patent
Takamatu

(10) Patent No.: US 6,807,839 B2
(45) Date of Patent: Oct. 26, 2004

(54) COLD FOLDING METHOD FOR A HOLLOW TUBE OF MAGNESIUM

(76) Inventor: Tutomu Takamatu, 1749-12 Yazuka-machi, Soka-shi, Saitama-ken (JP)

( * ) Notice: Subject to any disclaimer, the term of this patent is extended or adjusted under 35 U.S.C. 154(b) by 0 days.

(21) Appl. No.: 10/649,611

(22) Filed: Aug. 28, 2003

(65) Prior Publication Data

US 2004/0040363 A1 Mar. 4, 2004

(30) Foreign Application Priority Data

Aug. 30, 2002 (JP) ..... 2002-254670

(51) Int. Cl.[7] ..... B21D 7/08

(52) U.S. Cl. ..... 72/389.6; 72/389.1; 72/57; 72/213

(58) Field of Search ..... 72/389.1, 389.2, 72/389.6, 57, 61, 213

(56) References Cited

U.S. PATENT DOCUMENTS 1,530,528 A * 3/1925 Singer ..... 72/389.1
4,567,743 A * 2/1986 Cudini ..... 72/61
5,333,775 A * 8/1994 Bruggemann et al. ..... 72/61
5,661,994 A * 9/1997 Sundquist ..... 72/389.6
6,122,948 A * 9/2000 Moses ..... 72/61
6,128,942 A * 10/2000 Stevicks ..... 72/389.1

* cited by examiner

*Primary Examiner*—David B. Jones
(74) *Attorney, Agent, or Firm*—Wenderoth, Lind & Ponack, L.L.P.

(57) ABSTRACT

A method cold folds a hollow tube of magnesium material. The method includes providing an inner rib at opposite sides of a hollow square tube made of magnesium material, accommodating the square tube by having opposed ends of the square tube received in an upper portion guide member of a female mold, in an inner portion of the square tube received in a lower portion protection member of a male mold, and lowering the male mold to fold the square tube by the combination of a curved surface portion of the male mold and a curved surface of the female mold.

10 Claims, 8 Drawing Sheets

COLD FOLDING METHOD FOR A HOLLOW TUBE OF MAGNESIUM

BACKGROUND OF THE INVENTION

1. Field of the Invention

The present invention relates to a cold folding method for a hollow tube or pipe which is made substantially of magnesium, such as square tube, spectacle-type tube, circular tube, etc., wherein the tubes are folded by a press-working technique.

2. Prior Art Technique

When various kinds of press-working products manufactured from square tubes of iron are made into scrappage, and recycling of the scrappage is encouraged for resource preservation purposes, there are serious problems and disadvantages in that recycling requires a huge cost for recovery operations and transportation because the iron products are heavy and likely to be rusted and corroded and, therefore, provide serious problems and difficulties in handling and management. Moreover, the benefit gained by the resource recovery is quite small and it is extremely difficult to attempt to raise a recovery rate of the resources to thereby reduce the volume of waste.

Magnesium material and its products, which are generally substituted for iron material and products, being less efficient in recycling effect are light-weight, have a specific gravity of 1.74, which is about one-fourth of that of iron, and have a desirable handleability. Besides, the magnesium material, if molded by repeated press-working, provides a higher strength, which is as high as that of iron-made pipe, due to work-hardening. Therefore, keen attention has been paid to usage and application of the magnesium material as a metal material having a high recycling effect.

Magnesium material, which has less viscosity at room temperature, provides less extensibility of material when it is treated by a cold-press working and therefore, has some difficulty in a uniform extension of the material. Thus, a non-uniform pressure added to the material will result in the occurrence of cracks. Further, since it has a strong repulsive force, that is, a spring-back force against bending or folding by the press-working, it is difficult to place the material into a predetermined stable form and shape. The cold-press working requires a highly skilled technique, as well as further time and labor and, therefore, it is noted that folding work for a square tube is extremely difficult. Thus, in the conventional method, a hollow tube was filled with some padding before the folding work is conducted and this conventional method has serious problems of being time-consuming and inefficient workability.

Strength of a spectacle-type tube which is made of a magnesium material is examined by the help of Prof. Utsuo Yarita, of the Mechanical Engineering Dept., Chiba Institute of Technology, Chiba prefecture, Japan. The spectacle-type tube which was examined had a length of 500 mm, a diameter of 28 ϕ and a weight of 2.5 t, with its opposed ends being supported and a central load of 300 kgf added to obtain measurement of flexure under the conditions described above.

Flexure mm: Y; Load: P=300 kgf; Diameter of the tube: 28 ϕ;

Length of the tube: L=500 mm; Geometrical moment of inertia: I;

Modulus of longitudinal elasticity (Young's modulus);

$E=4500\ kg/mm^2$; $Y=-PL^3/48EI$

TABLE 1

| Tube Shape | Flexure (mm) | EI | Secondary Section Modulus |
|---|---|---|---|
| 28 ϕ-2.5 t | 4.57 | $73.9 \times 10^6$ | 16.427 |
| Vertical Direction (spectacle type) | 0.2 | $1.71 \times 10^9$ | 380.522 |
| Lateral Direction (spectacle type) | 1.02 | $328.5 \times 10^6$ | 73.074 |

Comparing the tube having a diameter of 28 ϕ with the spectacle-type tube described above, it was found that a flexural rigidity of the spectacle-type tube was larger in strength, as large as 23 times in a vertical direction and 4.4 times in a lateral direction. The experiment shows that the spectacle-type tube has an excellent mechanical strength.

SUMMARY OF THE INVENTION

In view of the foregoing, it is an object of the present invention to provide a new cold folding method for hollow tubes, made substantially of magnesium material, such as square tubes, spectacle-type tubes, general circular tubes, wherein the magnesium material is the lightest in weight among the structural metal materials and has an excellent recycling property and a resource-recovery property, and has energy-saving properties having environmental suitability.

According to a first aspect of the present invention, there is provided a cold folding method for a hollow tube of magnesium material, wherein the method uses an apparatus comprising:

a male mold, movable up and down, having a male lower surface portion at a lower portion thereof, a male side surface portion at opposite sides thereof, a male curved surface portion between the side ends of the male lower surface portion and the side surface portion, a lower protection member at the male lower surface portion and side portion protection members at the opposed sides of the side surface portions, female molds, in a paired configuration, each having a female front surface portion, a female upper surface portion, a female curved surface portion between the female front surface portion and the female upper surface portion, a front portion guide member at the front surface portion, and an upper portion guide member at the upper surface, the front portion guide member and the upper portion guide member being located at the lower position of the male mold in a spaced confronting relation with each other, wherein the method comprising the steps of:

providing an inner rib at opposite sides of a hollow square tube made of magnesium material, accommodating a middle portion of the square tube, having opposed ends received in the upper portion guide members of the female molds, in an inner portion of the lower portion protection member of the male mold, and lowering the male mold to fold the square tube by the combination of the curved surface portion of the male mold and the curved surfaces of the female molds.

In a preferred mode of the invention described above, a curved surface of the curved surface portion of the male mold is as large as 4.5 times or more of a curved surface of a folding diameter of the square tube.

In another preferred mode of the invention described above, the inner ribs are positioned, in a depressed configuration, on the opposite sides of the folded portion of the square tube such that each of the inner ribs is longer than a length of the curved surface.

In a further preferred mode of the invention, the lower portion protection member on both of the sides of the lower surface portion of the male mold and the upper portion guide member on both of the sides of the upper surface portions of the female molds are formed to accommodate the square tube therein.

According to the first aspect of the invention described above, while the square tube is protectively held at its opposed side surface portions by the lower portion of the protection members on the opposed sides of the male lower surface portion of the male mold and the upper guide member on the opposed sides of the female upper surface portion of the female molds which are movable toward and away from each other, the tube is pulled in and folded by the male curved surface portion and the female curved surface portions. Accordingly, the inner ribs are formed in the form of recesses on the opposed side surfaces of the folded portion of the tube, so that a mechanical strength is increased by raised portions which are formed at the circumferential portions of the inner ribs to thereby prevent the generation of cracks.

According to a second aspect of the present invention, there is provided a cold folding method for a hollow tube of magnesium material, wherein the method uses an apparatus comprising:

a male mold, movable up and down, having a recessed surface portion having a recess portion of the same diameter as a radius of the tube, a male lower surface portion, a male side surface portion on the both sides of the male lower surface portion, a male curved surface portion connecting the male lower surface portion and the male side surface portion, the male recess surface portion being formed continuously in the male lower surface portion, the male side surface portion and the male curved surface portion, and a male abutting member on the opposite sides of the male lower surface portion, the male side surface portion and the male curved surface portion, female molds of a paired configuration, movable back and forth, each having a female front surface recess portion having a recess of the same diameter as a radius of the tube on a front surface, a female upper surface recess portion having a recess of the same diameter as a radius of the tube on an upper surface, a female curved surface portion on a coupling portion between the front surface and the upper surface, a female curved surface portion on a coupling portion between the female front surface recess portion and the female upper surface recess portion, a female abutment portion formed continuously on the opposed sides of each of the female front surface recess portion, the female curved surface portion and the female upper surface recess portion, wherein the method comprising the steps of:

accommodating, inside the male recess surface portion of the male mold and the female curved surface portion of the female molds, the opposed ends of the hollow tube of a magnesium material into the female upper surface recess portion of the female molds, and lowering the male mold to fold the tube by the combination of the male curved surface portion on the lower surface of the male mold and the female curved surface portion of the female mold.

In a preferred mode of the invention of the second aspect described above, the male abutment portion is formed on the opposed sides of the male recess surface portion on the lower surface of the male mold, the male recess surface portion having a recess of the same diameter as a radius of the tube on the opposed sides, and the female abutment portion abutting against the male abutment portion is formed on the opposed sides of the female recess surface portion on the front surface and the upper surface of the female mold and on the opposed sides of the female curved surface portion of the coupling portion between the front surface and the upper surface.

In a further mode of the invention of the second aspect, the curved surface of the male curved surface portion of the male mold is folded to an extent that the curved surface becomes in the range of 3.2 to 3.5 times as large as the folding diameter of the tube.

According to the present invention, the male abutment portion formed on both of the sides of the male recess surface portion is placed in an abutment relation with respect to the female abutment portion formed on both of the sides of the female curved surface portion, so that the hollow tube in the form of a spectacle or binoculars configuration (hereinafter referred to as "spectacle-type" tube) is protected at its outside, and the male mold is lowered while the opposed ends of the tube are received or accommodated in the upper recess portion of the female mold. Then the fold-working is carried out while the tube is being drawn by the combination of the male curved surface portion of the male mold and the female curved surface portion of the female mold. This permits a desirable and refined finish of the folded tube.

BRIEF DESCRIPTION OF THE DRAWINGS

Other features and advantages of the present invention will appear more clearly upon reading the following detailed description, made with reference to the annexed drawings in which.

PREFERRED EMBODIMENTS OF THE INVENTION

Preferred embodiments of the present invention will be described with reference to the drawings.

Figure 1:
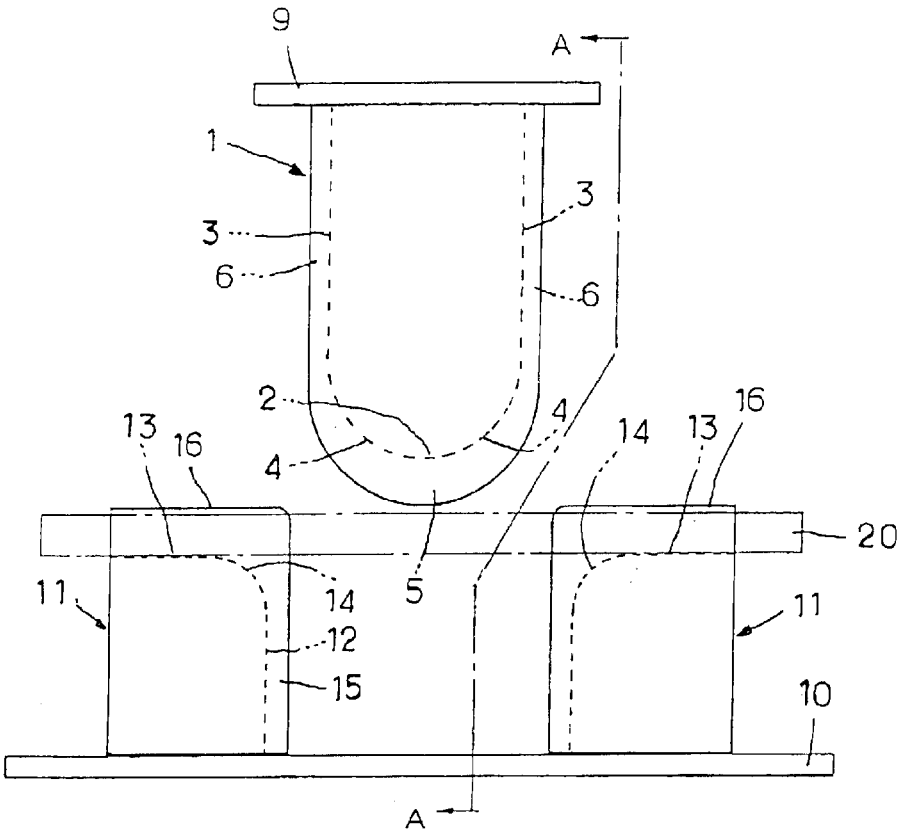
FIG. 1 is a front view of a press apparatus having a male mold and female molds of a paired configuration for folding a square tube made primarily of a magnesium material.
Figure 3:
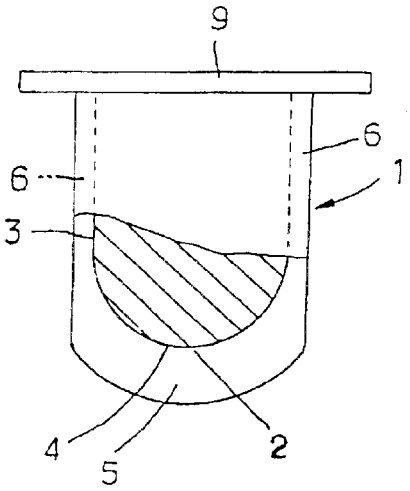
FIG. 3 is a partly fragmented front view of the male mold.

Referring first to FIGS. 1 and 3, a male mold 1 fixed at its end to a male base plate 9 has a male lower surface portion 2 at its lower portion, male side surface portions 3, 3 continuously formed on the opposed sides of the male lower surface portion 2, and a male curved surface portion 4 having a gently curved surface at a connecting portion between the male lower surface portion 2 and the male side surface portions 3,3. The male lower surface portion 2 and the male side surface portion 3 have a width (that is, a thickness) which is substantially same as a width N of a square tube 20, which will be described later. The male lower surface portion 2 is formed to have a predetermined shape such as a planar shape, an arch-shape, etc. suitable for final products to be worked and obtained.

When the press-worked products are of substantial U-shape, the male lower surface portion 2 is formed into an arc shape, and if it is U-shaped with a square end, the male lower surface portion 2 is formed into a planar shape. On the opposite sides in the widthwise direction of the male lower surface portion 2 and the male side surface portion 3, lower portion protection members 5, 5 and side portion protection members 6, 6 are formed respectively so that they serve to protect the side surface portions of the square tube. The lower portion protection member 5 and the side portion protection member 6 are connected together at their ends.

The lower portion protection member 5 is formed as long as, or longer than, the height M of the square tube accommodated in the male lower surface portion 2, and the side portion protection member 6 apart from the male lower surface portion 2 serves to protect opposed side portions of the square tube to thereby prevent the square tube which is to be folded by the male curved surface portion 4 from being twisted or distorted. Thus, it is not required that the length of the side portion protection member 6 be equal to the height (length) M of the square tube.

Figure 4:
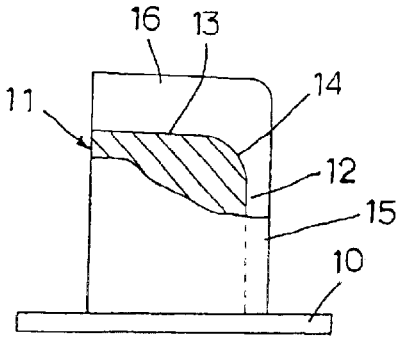
FIG. 4 is a partly fragmented front view of one of the paired female molds.
Figure 2:
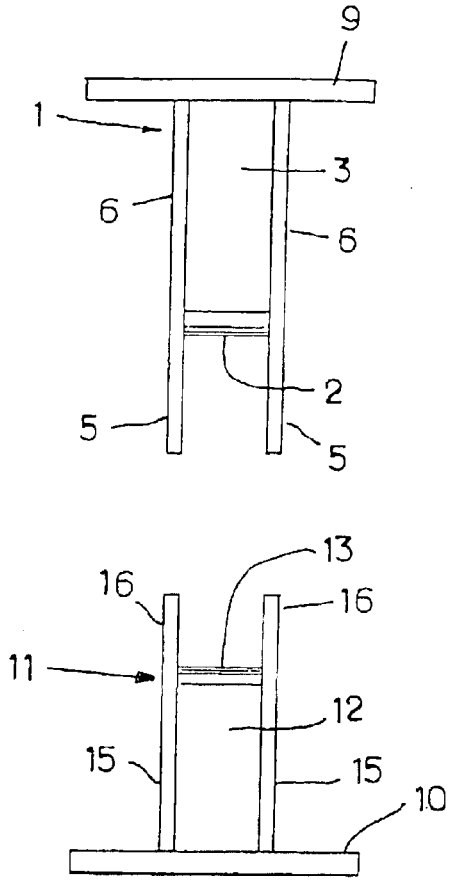
FIG. 2 is a side view of the press shown in FIG. 1, taken along A—A in FIG. 1 and viewed in the direction of arrows.

In FIGS. 1 and 4, reference numeral 11 represents female molds of a paired configuration which are located in a spaced confronting relation with each other on a female base plate 10 and movable back and forth. The female molds 11, 11 in a paired configuration, that is female mold halves 11 and 11, have planar female front surface portions 12, 12 in an opposed relation with the male side surface portions 3, 3 of the male mold 1, and female upper surface portions 13, 13 each having a planar or a gently curved surface on the upper surface. Further, female curved surface portions 14, 14 are formed to connect, in a gently sloped configuration, an upper end of the female front surface portion 12 with an front end of the female upper surface portion 13.

Figure 6:
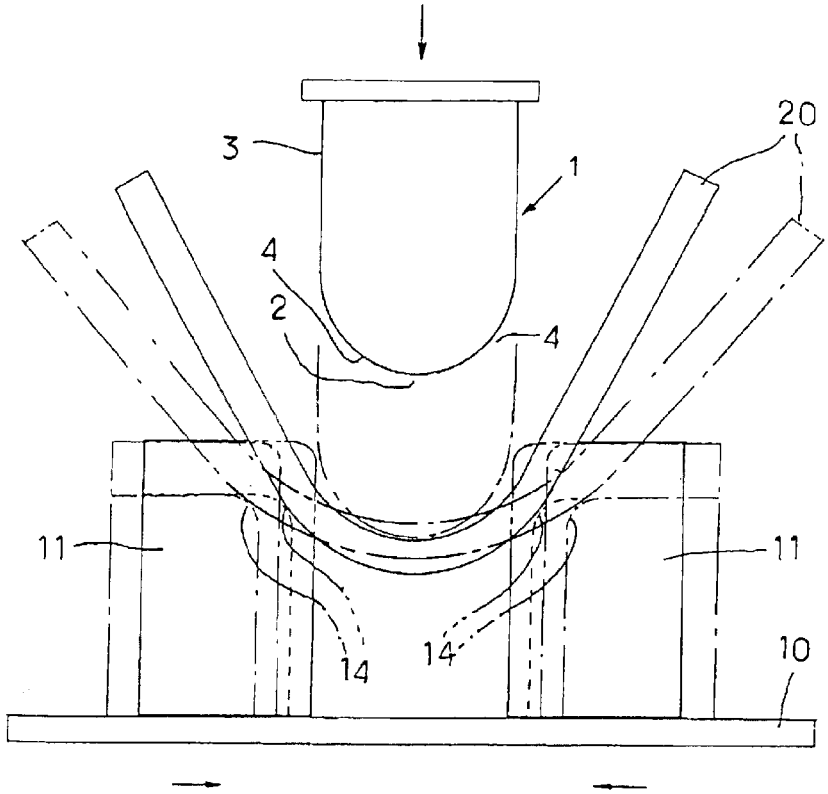
FIG. 6 is an explanatory diagram of the press apparatus showing that a folding angle of the square tube is changed by displacing the female molds.

As illustrated by dashed lines in FIG. 6, when the female molds 11, 11 disposed on either side of the female base plate 10 are displaced toward the male mold to shorten the distance between the male mold 1 and the female molds 11, a folding angle of the square tube 20, that is, an angle of the curved surface, can be made smaller as illustrated by solid lines. On the contrary, when the female molds 11 are displaced away from the male mold 1 to make the distance relative to the male mold 1 larger, the folding angle (that is, the curved surface) of the square tube 20 becomes larger to form a tube with a gentle curve.

In order to perform a folding operation on the square tube 20, the curved surface of the male curved surface portion 4 of the male mold is selectively determined in accordance with a predetermined folding angle, that is, under a yardstick of 4.5 times of a diameter of the internal angle of the square tube. If the angle is less than 4.5 times of the internal angle diameter, it is likely that cracks are produced on the side surface of the folded portion by the folding procedure. On the other hand, if the angle is as large as the 4.5 times or more of the internal angle diameter, it is noted that a favorable folding can be conducted in a smooth manner. The inventors have found, after various experiments by changing angles, that an angle of 4.5 times of the folding angle of the square tube is the optimal value as a minimum angle for the folding procedure. The female front surface portion 12 and the female upper surface portion 13 each has a width which is the same as the width of the male lower surface portion 2 and the male side surface portion 3 and also the same as the width of the square tube.

Front portion guide members 15, 15 having a guide function are provided on the opposed side ends in the widthwise direction of the female front surface portions 12, 12, and upper portion guide members 16, 16 having a guide function are provided on the opposed side ends in the widthwise direction of the female upper surface portion 13. The front portion guide member 15 and the upper portion guide member 16 are coupled together in a gently sloped configuration. The front portion guide member 15 and the upper portion guide member 16, as guide means, serve to hold the square tube 20 in position within the female front surface portion 12 and female upper surface portion 13 to thereby prevent these portions 12, 13 from being distorted or twisted away in the lateral direction from the predetermined position. However, it is not required that the front portion guide member 15 is formed longer because the front portion guide member 15 does not have to receive therein the square tube 20.

Figure 7:
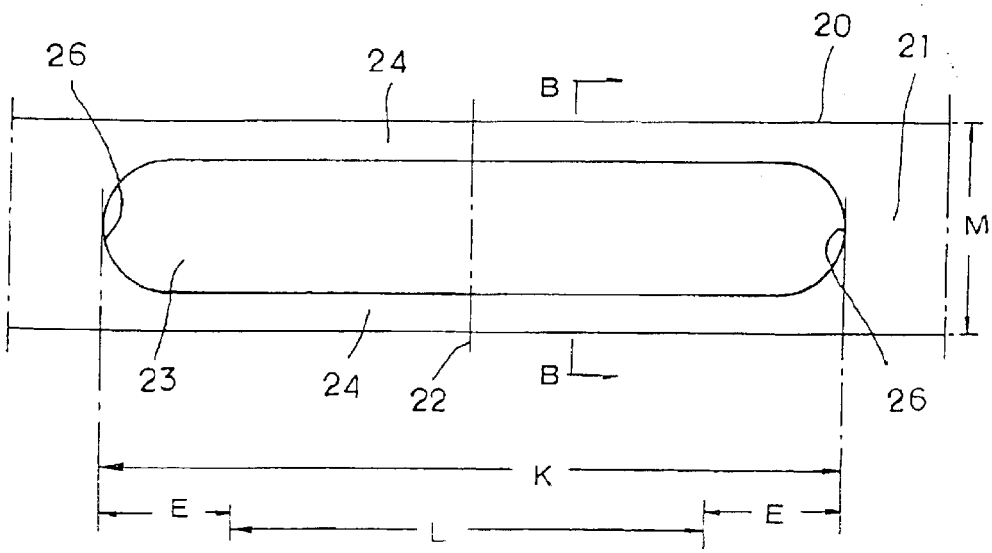
FIG. 7 is an enlarged front view of a part of the square tube having inner ribs on the opposed side surfaces.
Figure 8:
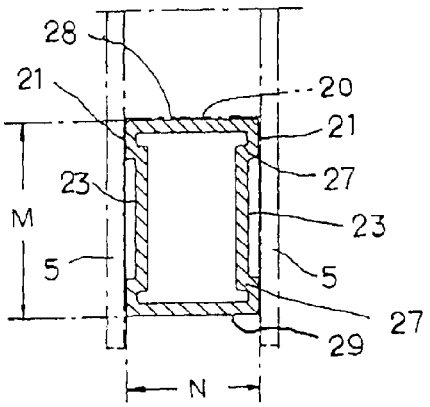
FIG. 8 is a sectional view of the tube, taken along B—B in FIG. 7.
Figure 9:
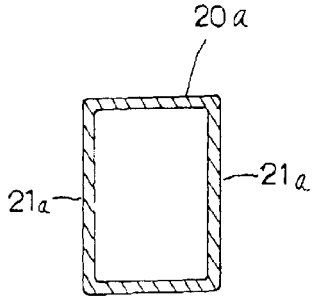
FIG. 9 is a sectional view of a square tube having no ribs on the inner side thereof.
Figure 10:
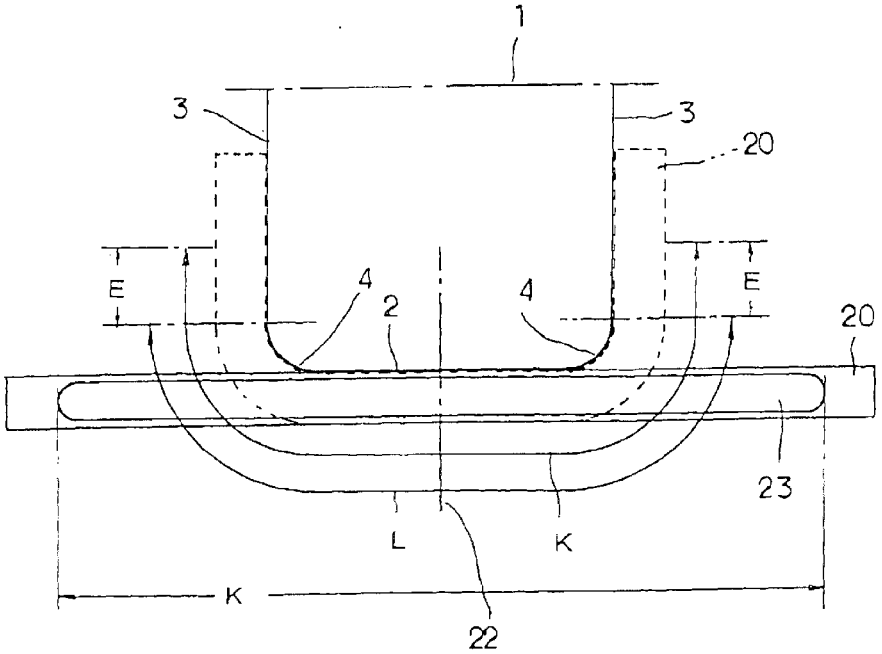
FIG. 10 is a diagram showing a relationship between a curved surface length "L" of the square tube and a length "K" of the inner rib.

FIGS. 7 through 9 show a square tube 20, as an example of the hollow tubes, formed by extruding magnesium material for the folding operation, which has a rectangular shape in cross section and is positioned with its shorter side at the top, and has inner ribs 23, 23 which are formed by depressing reinforcing ribs inwardly on the lateral (that is, right and left) direction from a folding central line shown by reference numeral 22 of the side surface portion 21 and 21. Referring to FIG. 7, a folding length of the square tube 20 to be folded in a round-shaped configuration is designated as "K", namely, the length of the inner ribs 23, 23 formed on the opposed side surface portions of the square tube 20 is supposed to be "K" wherein the inner ribs 23, 23 have extended portions E, E which are laterally (that is, in the right and left direction) extended by 30 mm or more, preferably approximately 50 mm, to be longer than the curved surface length L. A relationship between the length K of the inner ribs and the curved surface length L is shown in FIG. 10, in which it is shown that the curved surface length L occupies the folding portion, in which the extended portions E, E are added to the ends of the folding portion to thereby slightly enlarge the length of the inner ribs 23, 23 to make the length "K" as described.

On the upper and lower ends of the opposed side surface portions 21 of the square tube 20, flat end portions 24, 24 each having a width equal to a thickness of the square tube, for example, about 2 mm, are formed to be as long as the length of the inner ribs 23, 23 which are formed at a central portion of the side surface portion 21. The inner ribs 23, 23 are depressed inwardly to be as long as the thickness of the square tube to form raised portions 27, respectively, as shown in FIG. 8.

The square tube 20 of magnesium material has a thickness of about 2 mm, and the opposed end portions of the inner ribs 23 are formed into a gently curved portion 26 to avoid the formation of an acute angled portion so that a stress is not converged into a point. On the circumferential end portion of the inner rib 23, the raised portion 27 has substantially the same length as the thickness of the to-be-worked material; and when an external pressure is added to the folded portion of the square tube, the external pressure is absorbed by the raised portion 27 of the inner rib 23 to prevent the generation of cracks at the side surface portion 21 of the folded position of the square tube. As illustrated in FIG. 9, on the other hand, unless an inner rib such as the inner ribs 23 described above is formed on the side surface portions 21*a*, 21*a*, addition of the external pressure directly to the side surfaces 21*a*, 21*a* will result in generation of cracks at the time of folding process.

Next, a folding process of the square tube 20 of magnesium material, which is a type of hollow tube, by the use of the apparatus which has hereto been explained will be described.

In the first step, when opposed end portions of the square tube 20 are folded at 90 degrees to form a U-shaped configuration, the square tube 20 is received in the upper guide members 16, 16 of the female molds 11, 11 as illustrated in FIG. 1. In this case, the upper protection member 16 of the female mold and the lower portion protection member 5 of the male mold are each equal to the width N of the square tube 20 and, therefore, the square tube can be held in a predetermined correct posture. Besides, the lower portion protection member 5 and the upper portion guide member 16 are formed longer than a height M of (FIG. 8) of the square tube 20 and, therefore, the square tube can be received therein.

Figure 5:
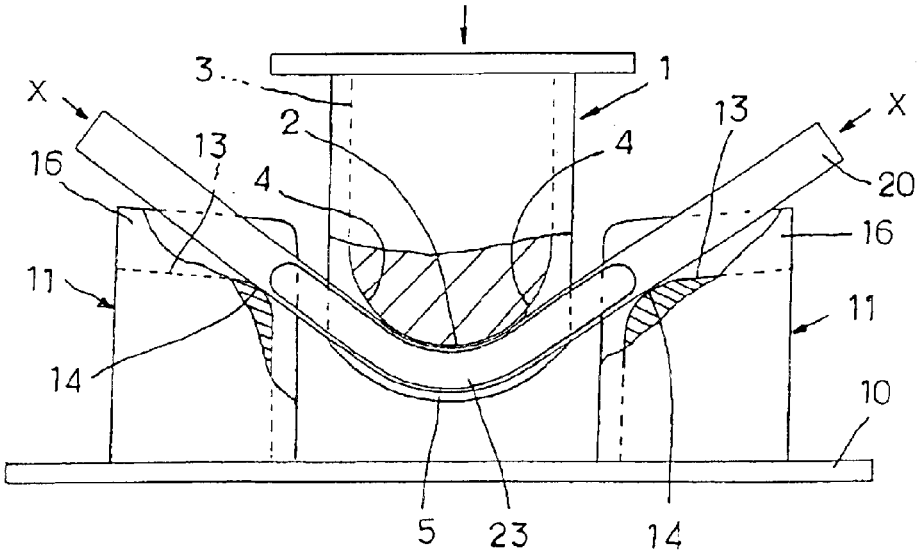
FIG. 5 is a partly fragmented front view of the press apparatus in the step of fold-working of a square tube.

In the second step, when the male mold 1 is lowered by the press operation, the square tube 20 which is located below the male mold is pushed down while it is being received in the lower protection member 5, and then pulled in as the male mold is being pushed down as illustrated by arrows X in FIG. 5. Since the opposed side surface portions 21, 21 of the square tube 20 are protected by the lower portion protection member 5 and the upper portion guide member 16 of the female mold, the upper surface portion 28 (FIG. 8) of the square tube is curved upward as illustrated in FIG. 5 by means of the male curved surface portion 4 of the male mold and the female curved surface 17 of the female mold, and the lower surface portion 29 (FIG. 8) as well is curved upward so that no distortion or twist of the tube will be produced in the lateral direction.

If desired, when the male mold 1 is lowered, a thin synthetic resin film such as styrene paper may be disposed between either the male mold 1 or the female molds 11, 11 and the square tube 20 so that a smooth folding operation can be carried out without any damage on the surface of the square tube 20. A plurality of sheets of the styrene paper, at least one and preferably two or three sheets, will be desirable so that they are slidable with each other. The styrene paper, if provided in plurality, has an advantage that each sheet of the styrene paper is independently movable.

As described above, the folding angle (that is, a curved surface) of the square tube can be selectively increased and decreased by reciprocally displacing the paired female molds 11 in the opposite direction toward and away from each other so that a distance between the paired female molds is made smaller or larger, as illustrated in FIG. 6.

The magnesium material has a strong spring-back property and when a square tube folded at about 90 degrees is expected to be obtained, it is recommended that the square tube be forcibly folded to an extent about 80 degrees and press-worked and then withdrawn from the male mold 1 and the female molds 11. The thus folded product at 80 degrees will be returned to the predetermined 90 degrees folded posture by the spring-back effect of the magnesium material. Therefore, it is desirable to proceed a folding operation by the adjustment of a stroke of the press-working under the consideration of the spring-back effect of the material, so that an excessive force is not added to the folding portion. This will prevent the generation of cracks on the opposed side surface portions of the folding portion of the square tube, so that a desired appearance of the folded portion of the square tube can be obtained.

Figure 17:
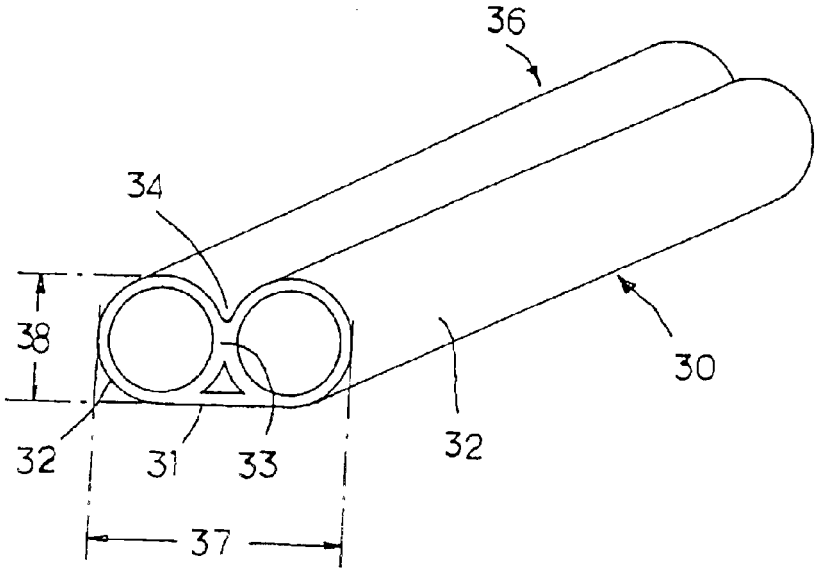
FIG. 17 is a perspective view of a spectacle-type tube of magnesium material.
Figure 18:
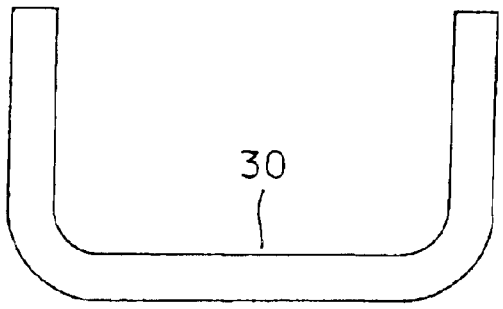
FIG. 18 is a front view of a hollow tube which is folded at substantially right angles.
Figure 19:
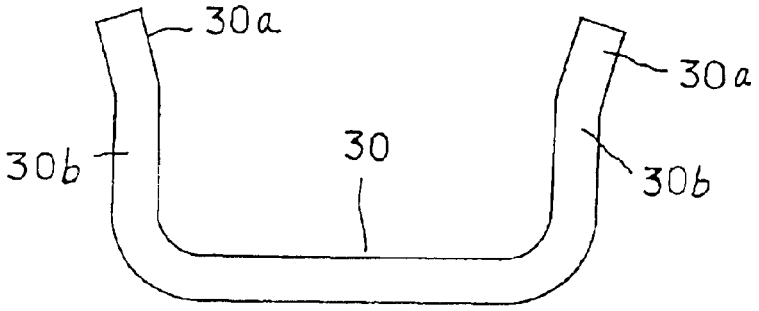
FIG. 19 is a side view of a spectacle-type tube made of magnesium material, showing the tube dilated at its opposed end portions by its spring-back effect.

Next, a second embodiment of the invention will be described. Referring to FIG. 17, a spectacle-type tube 30 produced by an extrusion method as a type of hollow tube has a planar base portion 31 and pipe portions 32, 32 on either side of the planar base portion 31 in a unitary structure. The planar base portion 31 of the spectacle type tube 30 has stronger spring-back than the other portions thereof. Therefore, when the tube 30 is pulled out of the male mold and the female molds after it is press-worked into a U-shape as illustrated in FIG. 18, the opposed ends 30*a*, 30*a* of the tube 30 are dilated or extended outwardly by the effect of the spring-back as shown in FIG. 19. On the opposite side of the planar base portion 31 of the tube 30, a groove 34 is formed at the middle portion along a curved surface base portion 36, and spring-back of the curved surface base portion 36 thus formed is slightly less than the spring-back of the planar base portion 31. Thus, it is possible, if necessary, to fold the tube 30 with either the planar base portion 31 or the curved surface base portion 36 being projected outwardly.

In FIGS. 11 through 16, a second male mold 40 which is fixed at its one end to a male base plate 44 has a male lower surface portion 39 at its lower surface. The male lower surface portion 39 is provided with a male recess portion 42 which has recess portions 41, 41 at the opposed ends such that the recess portions 41, 41 have a radius equal to a radius of the pipe portion 32 of the spectacle-type tube 30. A width of the male recess portion 42 is formed equal to a length of a lateral width portion 38 of the tube 30. Planar projection portions 43, 43 are formed on the opposed 20 end of the male recess portion 42 at the lower surface of the second male mold 40.

The male recess portion 42 is formed not only at the lower portion of the male lower surface portion 39, but also along the male side surface portions 39*a*, 39*a*, and the opposed ends of the male lower surface portion 39 are connected with the lower end of the side surface portion by means of male curved surface portions 45, 45 of a gently curved surface. The male curved surface portions 45 are formed in an arc shape so that its length is within a standard range of 3.2 to 3.5 times as long as a folding diameter, that is, a folded inner angle, of the spectacle-type tube 30. This range of numerical values was obtained by the inventors through various experiments with numerical values being changed.

Figure 13:
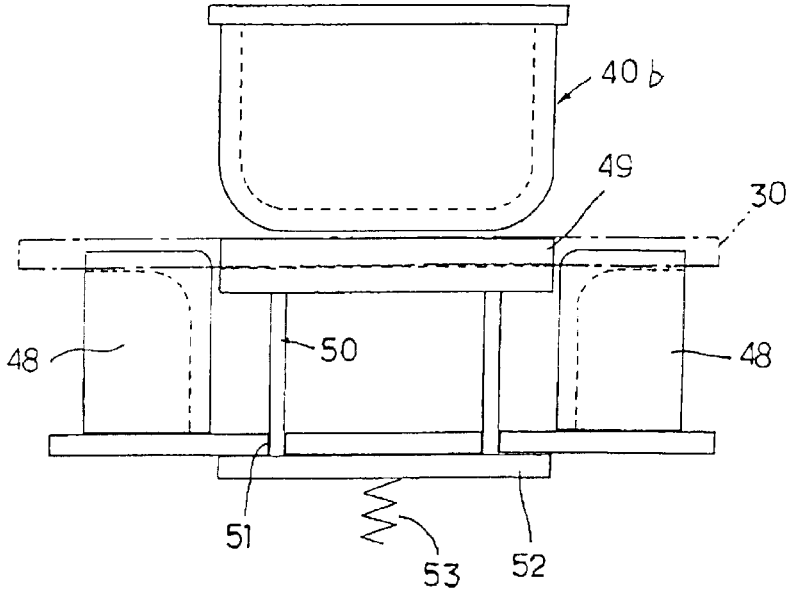
FIG. 13 is a front view of a press apparatus composed mainly of a male mold, a paired female molds and a vane plate for folding the spectacle-type tube made of magnesium material.

On a female base plate 46 which is placed below the male mold 40, a second paired female molds 48, 48 are disposed in a confronting relation such that the paired female molds 48, 48 are reciprocally displaced toward and away from each other in opposed directions. If desired, as shown in FIG. 13, a cantilever plate 49, movable upwardly and downwardly, may be provided at a lower portion of the male mold 40*b* between the paired female molds 48, 48. A coupling shaft 50 is connected at its one end to a lower surface of the cantilever plate 49 and is also connected at its other end to a supporting platform 52 through a through-hole 51 formed on the female base plate 46. The supporting platform 52 is generally spring-biased upwardly by means of a resilient member 53 such as a spring.

The cantilever plate 49 has, on its upper surface, a recess portion 55 in an opposed and paired relation to the male recess portion 42 of the male mold 40 so that the spectacle type tube 30 is accommodated within the thus formed paired recesses 42, 55. On the opposed sides of the recess portion 55 are provided recess portions 57, 57 each having a diameter equal to the radius of the tube portion 32 of the spectacle-type tube 30 in a similar manner as the case of the male mold 40. On the opposed sides of the recess portion 55 and at the upper end of the cantilever plate 49, abutment receiving portions 59, 59 are provided to abut against and receive the male abutment portions 43, 43.

Figure 11:
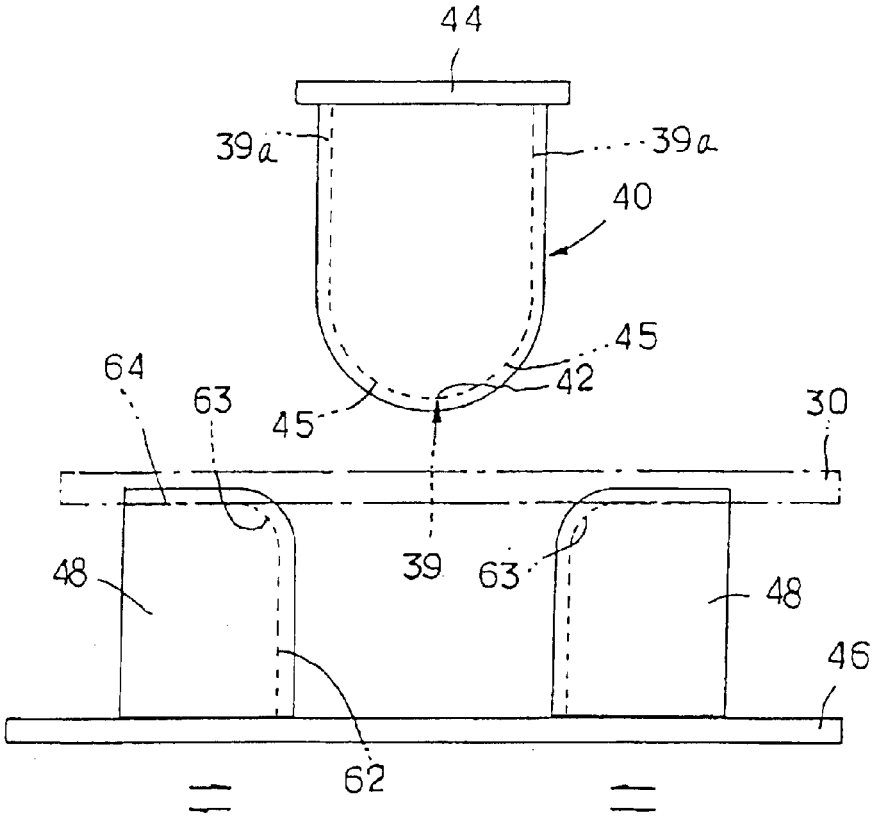
FIG. 11 is a front view of a press apparatus composed mainly of a male mold and female molds in a paired configuration for folding a spectacle type hollow tube made of magnesium material.
Figure 14:
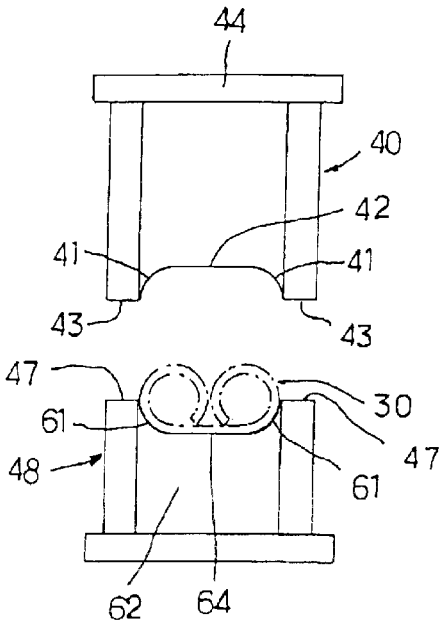
FIG. 14 is a side view of the male mold and the female mold showing the tube held by the male and female molds.

As illustrated in FIGS. 11 and 14, a recess portion 61 which has a radius equal to a radius of the spectacle-type tube 30 is provided on both sides of the upper and front surfaces of the female molds 48 to form a female front surface recess portion 62 and a female upper surface recess portion 64, each having a depth of half of the tube diameter 38 (FIG. 17). The female front surface recess portion 62 and the female upper surface recess portion 64 are connected together by a gently curved female curved surface portion 63. On the opposed sides of these female front surface recess portion 62, the female upper surface recess portion 64 and the female curved surface portion 63, it is shown that female abutment portions 47 are provided to contact against the aforementioned male abutment portions 43.

Figure 16:
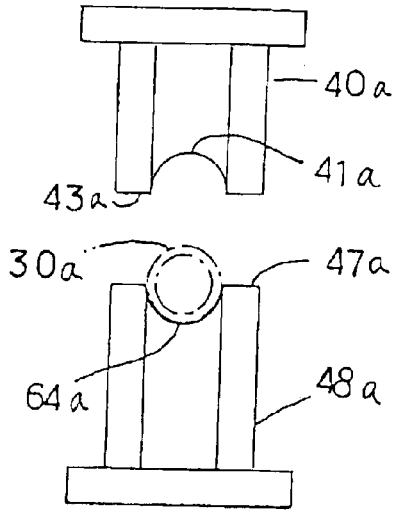
FIG. 16 is a side explanatory view of the male and female molds, showing a general circular tube is held by these molds for folding operation.

With reference to FIG. 16, when an ordinary type of circular tube 30*a* is provided for folding, the male mold 40 is provided, at its lower surface, with a recess portion 41*a* having a radius equal to a radius of the tube diameter, and the female mold 48*a* is provided with a recess portion 64*a* on the front surface, upper surface, and female curved surface portion. Further, on the opposed sides of these recessed portions 41*a*, 64*a*, a female abutment portion 47*a* is disposed for abutting against the male abutment portion 43*a*. By the construction described above, the circular tube 30*a* made of magnesium material is protected at its outer surface and processed in a smooth manner for folding operation, similar to the case of the aforementioned spectacle type tube.

Next, a fold-working method for the spectacle type tube will be explained. In the first step of operation, as shown in FIG. 11, a spectacle-type tube 30 is placed within the female upper surface recess portions 64, 64 of the female molds 48, 48 which are movable toward and away from each other on the opposed sides of the female base plate 46. In this case, if the cantilever plate 49 is provided, the tube 30 is accommodated in the recess surface portion 55, but the cantilever plate 49 can be omitted.

In the second step, when the male mold 40 is lowered, the male abutment portions 43 contacted against the female abutment portions 47 on the opposed sides of the female curved surface portions 63 of the female mold 48 and, therefore, an excessive or additional pressure that is more than required will not be added to the tube 30. In other words, the tube is held from upper and lower sides by means of the male curved surface portion 45 of the male mold 40 and the female curved surface portion 63 of the female molds 48.

In the third step, when the male mold 40 is lowered with the spectacle-type tube 30 being held, the female molds 48 are not lowered but held still, as they are, and the end portions of the tube 30 are folded upward by the male curved surface portion 45 of the male mold and the female curved surface portion 63 of the female mold.

Figure 15:
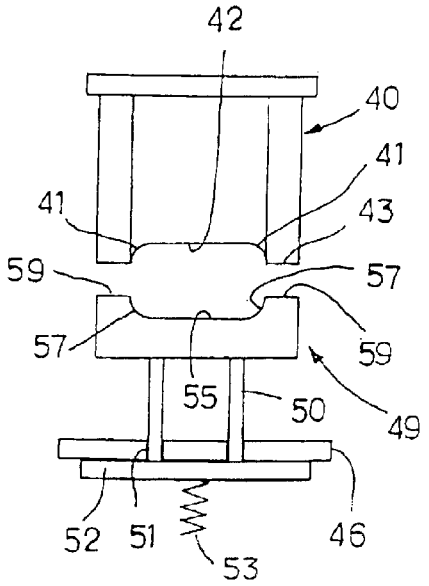
FIG. 15 is a side view showing the spectacle-type tube held by the male mold and the vane plate.

When the male mold 40 shown in FIG. 11 is lowered to its lowermost position, the spectacle-type tube 30 is taken into the female molds 48 as it is being bent or folded by the male mold 40 and the female curved surface portions 63 of the female molds 48. In this case, the external surface of the tube 30 is received and held by the male recess surface portion 42 of the male mold and the recess portions 61 of the female molds 48. In the case where the cantilever plate 49 is used as shown in FIG. 15, the abutment portions 43, 43 of the male mold come into contact with the abutment receiving portions 59, 59 to cover the exterior of the tube 30 and, therefore, no excessive force from the male mold 40 and the female mold 48 is added to the tube 30. Also in this case, press-working would be possible, if desired, by applying a styrene paper between the male mold or the female molds and the tube to avoid any damage to the surface of the tube. In order to prevent damage from occurring generated on the surface of the tube, it is desired that one styrene paper or more be used.

Figure 12:
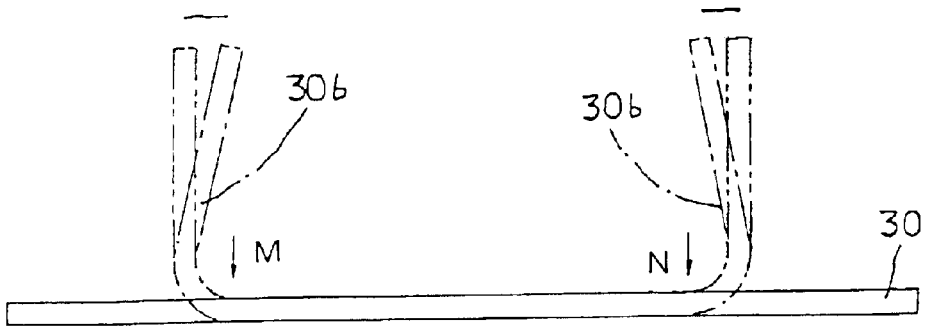
FIG. 12 is a front view of tube which is folded into a U-shape with a squarely folded corner by means of the combination of a male mold and paired female molds.

If it is required that the spectacle-type tube is folded into a U-shape of complete right angles at its folded corners, reference is made to FIG. 12 in which the opposed side portions of the raised portions 30*b*, 30*b* are bent at right angles at the fulcrum of arrows M and N, by initially folding one of the side portions and, thereafter, the remaining other side portion. In this case, no cantilever plate is used and, if it is folded forcibly to an extent of approximately 80 degrees, it is expected to be returned to a predetermined angle of 90 degrees by a spring back effect.

According to the first aspect of the present invention, while the square tube is protectively held at its opposed side surface portions by the lower portion of the protection members on the opposed sides of the male lower surface portion of the male mold and the upper guide member on the opposes sides of the female upper surface portion of the female molds which are movable toward and from each other, the tube is pulled in and folded by the male curved surface portion and the female curved surface portions. Accordingly, the inner ribs are formed in the form of recesses on the opposed side surfaces of the folded portion of the tube, so that a mechanical strength is increased by raised portions which are formed at the circumferential portions of the inner ribs to thereby prevent the generation of cracks.

In the second aspect of the present invention, the spectacle-type tube or the circular tube, both of which are other types of hollow tubing, is protectively held at its outer surface by the male abutment portion of the male curved surface portion of the male mold and the female abutment portion of the female curved surface portion of each of the female molds. Then, the male mold is lowered to pull in the tube by the male curved surface portion of the male mold and the female curved surface portions of the female molds to thereby fold the tube. This allows a beautifully finished surface of the tube without deformation at the folded portion of the tube.

What is claimed is:

1. A cold folding method for a hollow tube of magnesium material, wherein the method uses an apparatus comprising:

a male mold, movable up and down, having a male lower surface portion at a lower portion thereof, male side surface portions at opposite sides of the male lower surface portion, male curved surface portions between the male lower surface portion and the male side surface portions, male lower protection members at the male lower surface portion and male side portion protection members at opposed sides of the male side surface portions, and a pair of female molds, each having a female front surface portion, a female upper surface portion, a female curved surface portion between the female front surface portion and the female upper surface portion, front portion guide members at the female front surface portion, and upper portion guide members at the female upper surface portion, the method comprising:

providing inner ribs respectively at opposite sides of the hollow tube;

placing a section of the hollow tube in the apparatus such that opposed ends of the section are received in the upper portion guide members of the female molds and a portion of the hollow tube between the opposed ends of the section is received in an inner portion of the male lower protection members of the male mold; and lowering the male mold to fold the hollow tube by a combination of the male curved surface portions of the male mold and the female curved surface portions of the female molds.

2. A cold folding method according to claim 1, wherein curved surfaces of the male curved surface portions of the male mold are at least 4.5 times as large as a diameter of the fold of the hollow tube.

3. A cold folding method according to claim 1, wherein said providing of the inner ribs comprises depressing the inner ribs respectively on the opposite sides of the hollow tube at the section such that each of the inner ribs is longer than a length of a curved surface of the hollow tube created by said lowering of the male mold.

4. A cold folding method according to claim 1, wherein the lower portion protection members on the male mold and the upper portion guide members of the female molds are formed to accommodate therein the hollow tube.

5. A cold folding method according to claim 1, wherein the hollow tube is rectangular.

6. A cold folding method for a hollow tube of magnesium material, wherein the method uses an apparatus comprising:

a male mold, movable up and down, having a male lower surface portion, male side surface portions at opposite sides of the male lower surface portion, male curved surface portions connecting the male lower surface portion and the male side surface portions, and male abutment portions on opposite sides of the male lower surface portion, the male side surface portions and the male curved surface portions, wherein the male lower surface portion, the male side surface portions and the male curved surface portions have a continuous male recessed surface portion with at least one surface having a radius that is the same as a radius of at least a portion of the hollow tube, and a pair of female molds, movable back and forth, each having a female front surface recess portion on a front surface, a female upper surface recess portion on an upper surface, a female curved surface portion on a coupling portion between the front surface and the upper surface, and female abutment portions formed on opposed sides of the female front surface recess portion, the female curved surface portion and the female upper surface recess portion, wherein the female front surface recess portion, the female upper surface recess portion and the curved surface portion have a continuous female recessed surface portion with at least one surface having a radius that is the same as a radius of at least a portion of the hollow tube, the method comprising:

placing a section of the hollow tub in the apparatus within the continuous male recessed surface portion and the continuous female recessed surface portion such that opposed ends of the section are received in the female upper surface recess portions of the female molds and a portion of the hollow tube between the opposed ends of the section is received in the male lower surface portion of the male mold; and lowering the male mold to fold the hollow tube by a combination of the male curved surface portions of the male mold and the female curved surface portions of the female molds.

7. A cold folding method according to claim 6, wherein the male abutment portions are formed on opposed sides of the continuous male recessed surface portion on a lower surface of the male mold and the female abutment portions for abutting against the male abutment portions are formed on opposed sides of the continuous female recessed surface portion on the front surfaces, the upper surfaces and the female curved surface portions of the female molds.

8. A cold folding method according to claim 6, wherein curved surfaces of the male curved surface portions of the male mold are 3.2 to 3.5 times as large as a diameter of the fold of the hollow tube.

9. A cold folding method according to claim 6, wherein the hollow tube is circular.

10. A cold folding method according to claim 6, wherein the hollow tube spectacle-shaped.

* * * * *